United States Patent [19]

Alwine

[11] 4,031,874

[45] June 28, 1977

[54] CARBURETOR

[76] Inventor: John E. Alwine, 4341 Willow Brook Ave., Apt. 102, Los Angeles, Calif. 90029

[22] Filed: Oct. 8, 1975

[21] Appl. No.: 620,843

[52] U.S. Cl. ..... 123/134; 123/133; 261/113

[51] Int. Cl.[2] ..... F02M 17/22

[58] Field of Search ..... 123/133, 134, 135; 261/109, 111, 113

[56] References Cited

UNITED STATES PATENTS

| | | | |
|---|---|---|---|
| 420,591 | 2/1890 | Dawson | 123/133 |
| 544,879 | 8/1895 | Best | 123/133 |
| 550,776 | 12/1895 | Bourgeois | 123/134 |
| 932,478 | 8/1909 | Laux | 261/113 |
| 1,050,322 | 1/1913 | Woodworth | 261/113 |
| 1,779,921 | 10/1930 | Sullivan | 123/133 |

*Primary Examiner*—Ronald H. Lazarus
*Attorney, Agent, or Firm*—Thomas Hooker

[57] ABSTRACT

A carburetor for an internal combustion engine includes a body having a series of interior baffle plates through which liquid fuel and air are drawn to vaporize the fuel and form a gaseous fuel mixture. The mixture is drawn into a fuel mixture tube leading upward from the bottom of the series of baffle plates. Excess fuel is collected in the bottom of the carburetor body and pumped back to the fuel tank.

6 Claims, 4 Drawing Figures

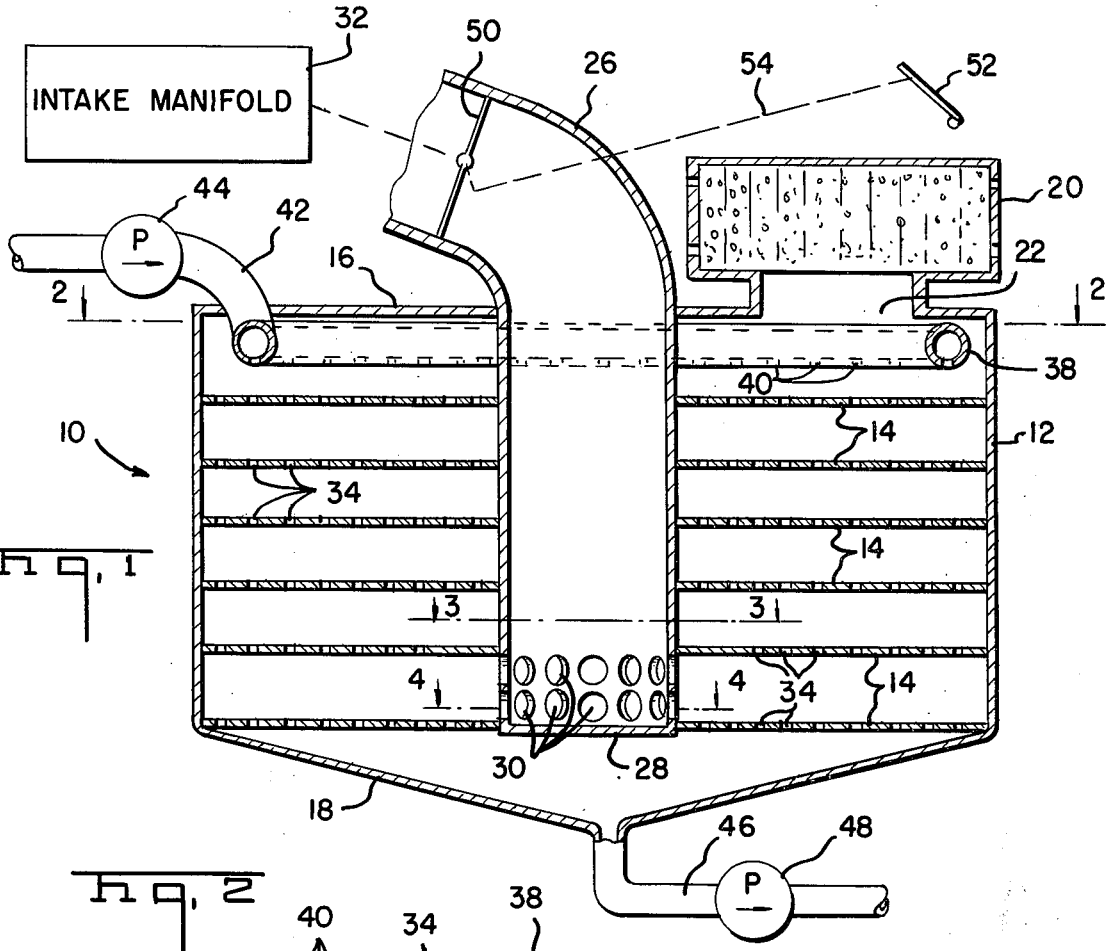
Fig. 1
Fig. 2
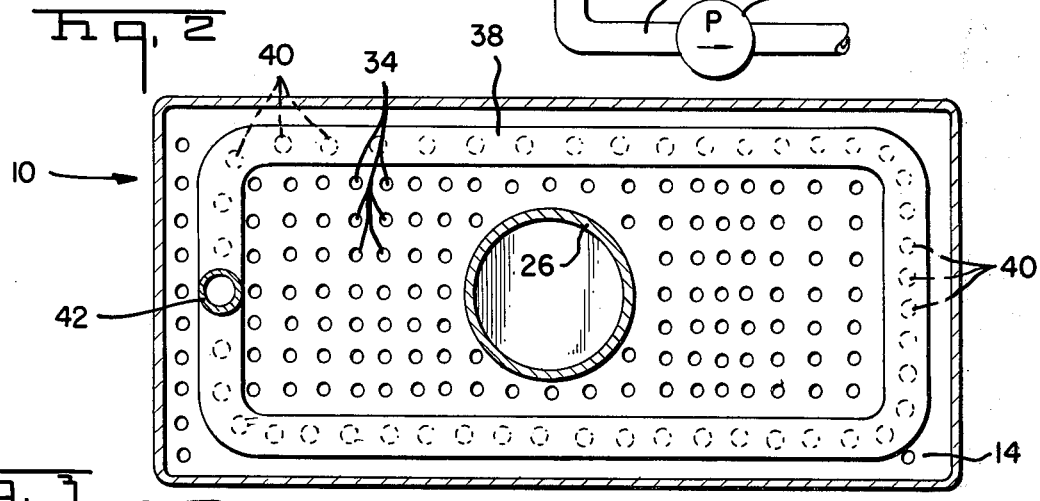
Fig. 3
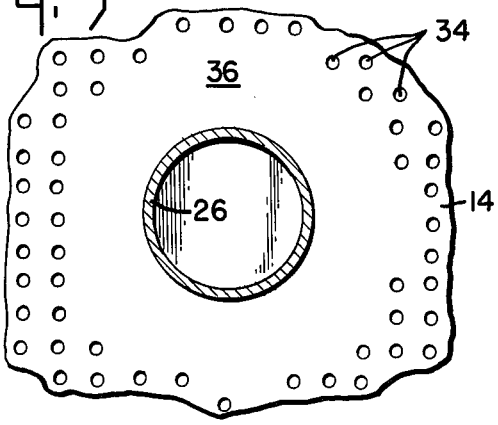
Fig. 4
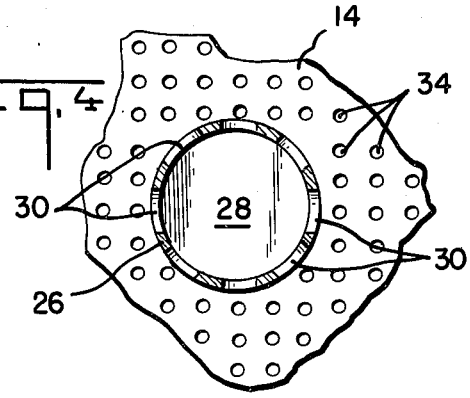

CARBURETOR

The invention relates to carburetors for internal combustion engines and more particularly to an improved evaporativetype carburetor for use in forming a combustion mixture between air and a highly volatile fuel, such as gasoline. Conventional evaporative carburetors are shown in U.S. Pats. Nos. 923,478 and 1,779,921.

In the carburetor of the present invention, a supply of fuel, preferably gasoline, is distributed over the uppermost of a series of generally horizontal baffle plates confined in the carburetor body. A fuel mixture tube running from the intake manifold extends down through the baffle plates to an inlet opening at the bottom of the plates. Air flows into the carburetor body from above the uppermost baffle plate so that when the engine is running air and liquid fuel are drawn through small openings or perforations formed through the baffle plates so that the air and liquid fuel are intimately mixed, resulting in vaporization of the fuel and formation of a desired gaseous fuel mixture. The mixture is drawn into the mixture tube through the inlet opening and then up the fuel mixture tube to the intake manifold. The inlet opening in the mixture tube is located immediately beneath an imperforate area of one of the baffle plates so that unevaporated liquid fuel is not drawn down through the plate in the vacinity of the inlet opening and, accordingly, the possibility of liquid fuel being drawn into the fuel mixture tube is reduced. The fuel mixture tube extends up from the inlet opening to further reduce the possiblity of liquid fuel being drawn into the intake manifold. Excess fuel is collected at the bottom of the carburetor body and is pumped back to the fuel tank.

The carburetor of the present invention vaporizes liquid fuel very efficiently, making it particularly advantageous when used to supply a gaseous fuel mixture to an automobile engine. This efficiency results in improved gasoline mileage over that achieved by use of a conventional venturi-type carburetor. Exhaust pollutants are also reduced.

Other objects and features of the invention will become apparent as the description proceeds, especially when taken in conjunction with the accompanying drawings illustrating the invention, of which there is one sheet.

IN THE DRAWINGS

FIG. 1 is a vertical sectional view illustrating a a carburetor according to the invention; and FIGS. 2, 3, and 4 are views taken respectively along lines 2—2, 3—3, and 4—4 of FIG. 1.

Carburetor 10 includes a hollow body 12, preferably formed of metal surrounding a series of perforated horizontal baffle plates 14 secured to the side walls of the body. The baffle plates are spaced apart and extend from the top 16 to the bottom 18 of the body. A conventional air filter 20 is mounted on the top of the body to permit filtered air to flow into the body through air inlet opening 22. Fuel mixture pipe 26 extends down through the top 16 of the body and through the baffle plates 14 to a closed end 28 at the lowermost plate. The plates tightly engage the pipe 26. A series of inlet openings 30 are provided in pipe 26 between the bottom two baffle plates. As illustrated in FIG. 4, the openings 30 extend circumferentially around pipe 26. The other end of pipe 26 is connected to the intake manifold 32 of an internal combustion engine (not illustrated).

Closely spaced small diameter fuel distribution holes or perforations 34 are formed through baffle plates 14 as illustrated. The entire area of the plates 14 is peforated with the exception of an annular area 36 of the next to lowest plate 14 surrounding pipe 26 above the inlet openings 30. A fuel inlet tube 38 extends around the inner circumference of body 12 between the top 16 and the uppermost baffle plate 14. A number of spaced fuel distribution openings 40 are formed through the bottom of tube 38 at regular intervals along its length.

The carburetor bottom 18 is downwardly dished to form a sump which collects excess liquid fuel drawn down from the lowermost baffle plate 14 and channels this fuel to return fuel line 46 extending from the lowest point of the bottom to the fuel tank. Scavenge fuel pump 48 pumps the excess fuel collected at bottom 18 back to the tank.

A butterfly-type throttle valve 50 is located in fuel mixture tube 26 between carburetor 10 and the intake manifold and is connected to a throttle setting device 52, such as an accelerator in the case the carburetor is used to supply fuel to the engine of an automobile, by a suitable linkage 54. If desired, a choke valve may be provided between the air filter 20 and the air inlet opening 22 in the top of the body 10. Such a choke valve should be used during starting and warm up when the internal combustion engine requires a rich fuel mixture.

When the internal combustion engine is in operation, fuel pump 44 delivers fuel to the fuel distribution tube 38 so that a supply of liquid fuel flows through openings 40 onto the top of the uppermost baffle plate 14 and, in combination with the air drawn into the carburetor body 12 through air inlet opening 22, is drawn down through the small perforations 34 formed through the uppermost and successive baffle plates 14. During passage of the liquid fuel and air through the perforations in the baffle plates, the liquid fuel is broken down into small particles and intimately mixed with the air so that a high degree of evaporization occurs, resulting in the formation of a desired gaseous fuel mixture. This progressively enriched mixture, together with unevaporated fuel particles, is drawn down through the baffle plates to the space between the lower two baffle plates where the gaseous fuel mixture is drawn through openings 30 into the pipe 26 and up the pipe to the intake manifold to fuel the engine. The imperforate area 36 surrounding the fuel mixture pipe 26 above intake openings 30 prevents unvaporized fuel particles from being drawn down through the baffle plate 14 adjacent the inlet openings so that the unevaporated fuel is not drawn into the pipe 25. The excess liquid fuel falls on the lowermost baffle plate, flows through the openings therein and is collected on the bottom of the carburetor body and channeled to the return fuel line 44 and is pumped back to the fuel tank.

Pump 44 delivers more fuel to the carburetor 10 than is evaporated during descent of the fuel through the baffle plates. This means that there is an excess of fuel collected on bottom 18 and pumped back to the fuel tank through return fuel line 46. The excess of available fuel assures that maximum vaporization occurs as the fuel and air are drawn through the baffle plates. The supply of fuel provided by pump 44 may be dependent upon the speed of operation of the internal combustion engine so that when the speed of the engine increases or decreases the amount of fuel supplied correspondingly increases and decreases and is vaporized with the respectively greater or decreased volume of air drawn into the carburetor body through openings 22.

If desired, the evaporative carburetor 10 as disclosed herein may be used on an engine with a conventional venturitype carburetor by attaching the end of the fuel mixture pipe 26 to the inlet of the venturi-type carburetor. The throttle valve of the conventional carburetor would then replace the throttle valve 50.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A carburetor for supplying a fuel mixture to an internal combustion engine including a closed hollow body, a series of closely perforated baffle plates extending between the side walls of the body and spaced apart between the top and bottom of the body, an air inlet opening in the body above the uppermost baffle plate, a fuel mixture pipe extending into the body through the top of the body, down through a number of baffle plates to an inlet opening located below a number of baffle plates, the portion of the baffle plate immediately above the inlet opening being imperforate adjacent the pipe to prevent excess liquid fuel from being drawn through such plate immediately adjacent the inlet opening, a fuel supply for distributing liquid fuel over the uppermost of said baffle plates so that when the engine is in operation liquid fuel and air are drawn down through the perforations in the baffle plates and the fuel is evaporated to form a gaseous fuel mixture subsequently drawn into the fuel mixture pipe through said inlet openings, the bottom of the body forming a sump for collection of excess liquid fuel and a return fuel system for flowing such liquid fuel away from the carburetor.

2. A carburetor for supplying a fuel mixture to an internal combustion engine including a closed hollow body, a series of closely perforated baffle plates extending between the side walls of the body and spaced apart between the top and bottom of the body, an air inlet opening in the body above the uppermost baffle plate, a fuel mixture pipe extending into the body and having an inlet opening located below a number of said baffle plates and between the two bottom most baffle plates a fuel supply for distributing liquid fuel over the uppermost of said baffle plates so that when the engine is in operation liquid fuel and air are drawn down through the perforations in the baffle plates and the fuel is evaporated to form a gaseous fuel mixture subsequently drawn into the fuel mixture pipe through said inlet openings, the bottom of the body forming a sump for collection of excess liquid fuel and a return fuel system for flowing such liquid fuel away from the carburetor.

3. A carburetor as in claim 2 wherein the portion of the baffle plate immediately above the inlet opening adjacent the fuel mixture pipe is imperforate.

4. A carburetor as in claim 3 wherein the fuel mixture pipe is located away from the side walls of the body and is surrounded by the baffle plates.

5. A carburetor as in claim 4 wherein the end of the pipe is closed.

6. A carburetor as in claim 4 wherein the fuel supply includes a fuel distribution tube extending around the inner circumference of the body above the uppermost baffle plate, fuel distribution openings in the tube at intervals along its length and fuel line joining said tube and extending outwardly of the body for supplying a flow of liquid fuel to the tube for distribution of liquid fuel onto the uppermost baffle plate.

* * * * *